United States Patent [19]

Goto

[11] Patent Number: 4,901,900

[45] Date of Patent: Feb. 20, 1990

[54] CONNECTOR FOR STRING INSTRUMENT AND HARNESS

[75] Inventor: Takao Goto, Isezakishi, Japan

[73] Assignee: Gotoh Gut Yugen Kaisha, Gunmaken, Japan

[21] Appl. No.: 182,894

[22] Filed: Apr. 18, 1988

[30] Foreign Application Priority Data

Apr. 20, 1987 [JP] Japan ..... 62-60775[U]

[51] Int. Cl.[4] ..... A45F 3/14; G10D 3/00

[52] U.S. Cl. ..... 224/257; 224/271; 84/327; 24/644

[58] Field of Search ..... 224/257, 910, 271; 24/644, 646, 647, 662, 663, 664, 665, 666, 667; 292/34, 37, 169; 403/289, 290, 325; 128/202.77; 84/327

[56] References Cited

U.S. PATENT DOCUMENTS

| | | | |
|---|---|---|---|
| 2,423,980 | 7/1947 | Jurrat | 292/37 |
| 3,302,507 | 2/1967 | Fender | 84/327 |
| 4,028,981 | 6/1977 | Cravens | 24/211 |
| 4,144,794 | 3/1979 | Silverman et al. | 224/257 |
| 4,274,181 | 6/1981 | Schaller | 224/257 |
| 4,291,822 | 9/1981 | Simonds | 224/257 |

*Primary Examiner*—Henry J. Recla
*Assistant Examiner*—Glenn T. Barrett
*Attorney, Agent, or Firm*—Wenderoth, Lind & Ponack

[57] ABSTRACT

A connector for a string instrument and a harness having a fixing member fixed to the body of the string instrument and an engaging member fastened to an end of the harness which can be removably connected to the fixing member.

The engaging member is provided with an engaging chamber and the fixing member is provided with a protrusion which can be fitted into the engaging chamber.

The engaging member is provided with at least two engaging pieces which are always energized by a resetting spring to engage with the protrusion of the engaging member which stays inside the engaging chamber and a manually-operated knob for disengaging the engaging pieces from the protrusion as required.

The manually-operated knob is adapted to retract the engaging pieces against the resetting spring by manually rotating the knob in the circumferential direction.

3 Claims, 3 Drawing Sheets

CONNECTOR FOR STRING INSTRUMENT AND HARNESS

BACKGROUND OF THE INVENTION

The present invention relates to the connector for the harness of the string instrument such as a guitar for suspending the string instrument from the shoulder or neck of the player, particularly a mating type connector.

The band for suspending the string instrument such as a guitar from the shoulder or neck of the player is referred to as the "harness" and both ends of the harness are respectively fastened to both ends of the body of the string instrument.

Of the two fastening ends of the harness, the fastening end which is mainly connected to the body bottom of the string instrument is provided with a connector for refittably connecting the fastening end of said harness to the body of string instrument, and thus the harness is removed from the player's shoulder or neck or suspended from the shoulder or neck of the player.

This connector comprises a manually-operated engaging member fixed to the fastening end of the harness and a fixing member provided at the body bottom of the string instrument as disclosed in, for example, the Specification of the U.S. Pat. No. 4,144,794 and is adapted to engage and disengage the end part of the harness with and from the body of string instrument by manually operating said engaging member to be engaged with and disengaged from said fixing member.

Such a conventional connector as described above is constructed so that the manually-operated engaged member has a male construction to be fitted and engaged with the fixing member which has a female construction, and engagement and disengagement of the engaging member require pressing or pulling of the manual push button from the outside in the axial direction of the fixing member.

For example, the connector disclosed in said U.S. Patent Specification is adapted so that a pin is provided at the engaging member side to make engaging balls protruding from and fitted to the outside of the pin retract into the pin when the push button is pressed while the receiving chamber into which said pin is tightly fitted is provided in said fixing member and a groove which engages with said engaging balls is circumferentially provided inside said receiving chamber so that the pin can be inserted into and removed from the receiving chamber by pressing said push button to accommodate the engaging balls into the pin and said engaging balls are engaged with said groove by inserting said pin into the receiving chamber and releasing said push button to allow the engaging balls to protrude outside the pin.

Such a conventional connector as described above requires respectively the push button operation both when the engaging member is forced to engage with the fixing member and when the engaging member is forced to disengage from the fixing member, and therefore such connector has a problem that the handling operation when engaging and disengaging frequently the fastening end of the harness to/from the string instrument will be extremely troublesome and another problem that engaging and disengaging of the engaging member and the fixing member while pressing of the push button in the axial direction is poor in simplicity and convenience since a pressure applied to the string instrument to move it and the playing hands of the player will be unstable while the string instrument is suspended from the shoulder or neck of the player.

Such connector is available in a type that has the fixing member fitted to the engaging member by transversely sliding it as disclosed in the Specification of the U.S. Pat. No. 4,274,181. However, this type of connector is disadvantageous in that the fixing effect when the connector is engaged is poor because this type is not the so-called mating construction and on inconvenience in the handling as in case of the aforementioned conventional connector still remains since it is necessary to draw out the plunger in the axial direction when disengaging the harness from the string instrument.

SUMMARY OF THE INVENTION

An object of the present invention is to provide a connector which does not require the operation of the push button when connecting the harness to the string instrument.

For this object, the connector in accordance with the present invention is constructed so that the engaging chamber is formed in the casing of the engaging member provided on the harness and the protrusion of the fixing member provided on the string instrument is fitted into said engaging chamber. Inside the engaging chamber of said engaging member, at least two engaging pieces are provided which always engage with the protrusion which is fitted into the engaging chamber and always advanced into the engaging chamber to be energized to hold the protrusion by the resetting spring. Accordingly, when said protrusion is fitted into the engaging chamber, the engaging pieces can be retracted against the resetting spring by the motion of the protrusion.

Said protrusion is provided with an engaging recession at a position nearer to the string instrument than its top, and said engaging pieces are engaged with this engaging recession to hold the protrusion in the engaging chamber.

In case of the connector in accordance with the present invention, when the fastening end of the harness is depressed onto the fixing member of the string instrument, the protrusion is automatically fitted into the engaging chamber and engaged with the engaging pieces so as to be unremovable.

Another object of the present invention is to provide a connector which facilitates removing of the harness from the string instrument.

For this object, the connector in accordance with the present invention is constructed so that the operation knob which is protruded outside the harness is provided on said engaging member and the engaging pieces in said engaging chamber are retracted against said resetting spring by manually rotating this knob in the circumferential direction so that said protrusion can be disengaged from the engaging chamber.

Accordingly, in case of the connector of the present invention, the harness can be easily disengaged from the string instrument without causing the string instrument to be unstable since the operation knob is operated while applying a force in the direction where the harness is pulled when removing the harness.

Another further object of the present invention is to provide a connector capable of improving close contacting of the engaging member and the fixing member.

Therefore, the connector in accordance with the present invention is provided with an elastic cushioning means at the fitting surface of the fixing member facing the string instrument and thus the engaging pieces and the protrusion are kept closely engaged.

DETAILED DESCRIPTION OF PREFERRED EMBODIMENT

Figure 1:
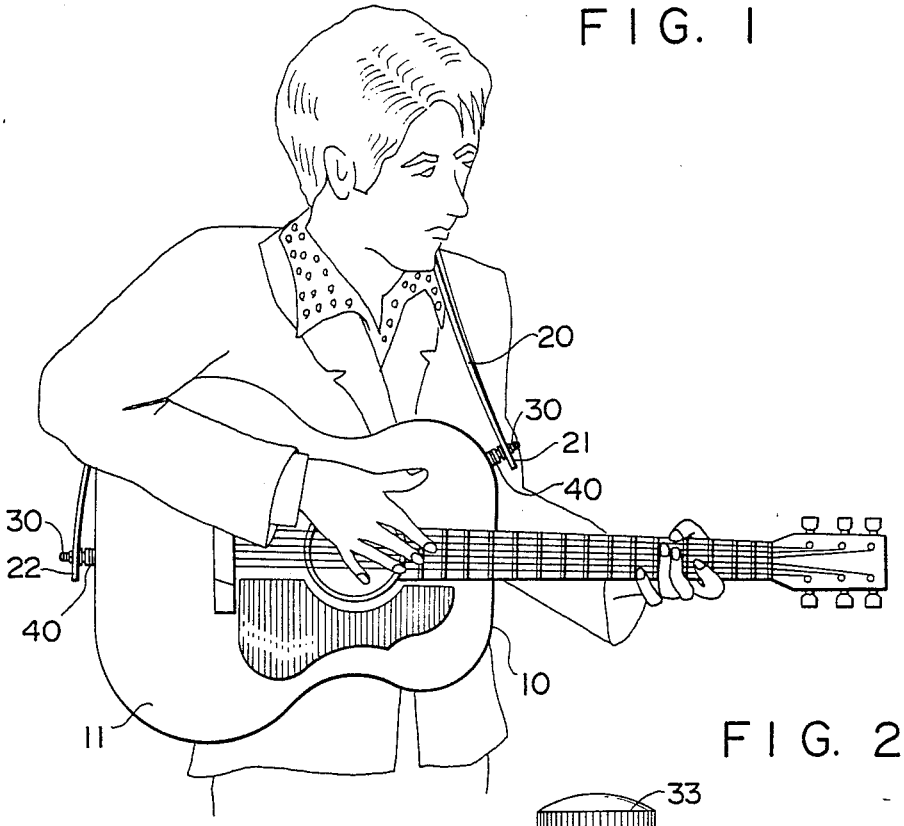
FIG. 1 is a front view showing the string instrument employing the connector in accordance with the present invention which is being used.

Referring to FIG. 1, there is shown a string instrument employing the connector in accordance with the present invention such as, for example, guitar 10. Fastening ends 21 and 22 of the harness 20 are respectively connected to the front and bottom parts of the body 11 of this guitar 10.

The connector in accordance with the present invention is used at said fastening ends of the harness, and manually-operated engaging members 30 are respectively fitted to the fastening ends 21 and 22 of the harness and the fixing members 40 are provided on the body 22 of the guitar 10.

Figure 3:
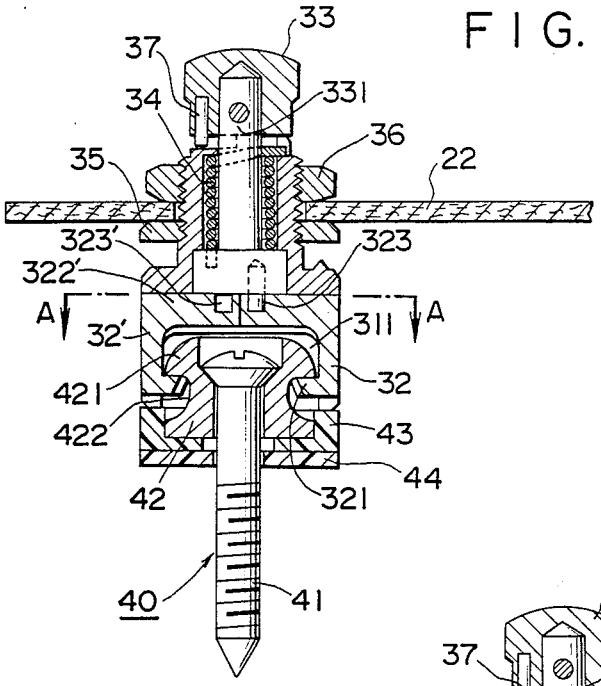
FIG. 3 is a vertical crosssectional front view of said connector.
Figure 4:
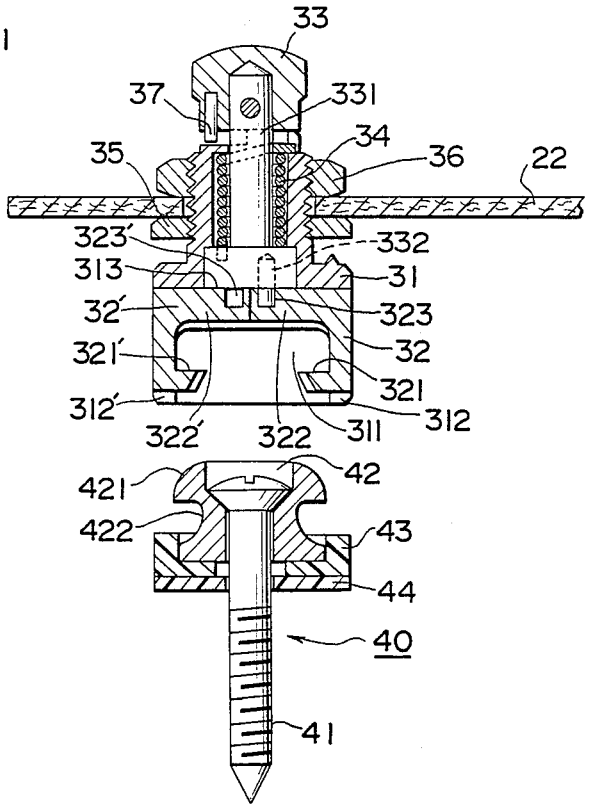
FIG. 4 is a vertical crosssectional front view showing said connector which is disengaged.

Said engaging member 30, as shown in FIG. 3, has a casing 31 having an engaging chamber 311 which is open at its front side and notches 312 and 312' opposed in the radial direction are formed in this casing 31 as shown in FIG. 4.

Engaging pieces 32 and 32' are fitted into this pair of notches 312 and 312', and these engaging pieces 32 and 32' are fitted in the casing 31 so that the engaging pieces can be guided by a slideway 313 provided in the internal bottom of the casing 31.

Figure 2:
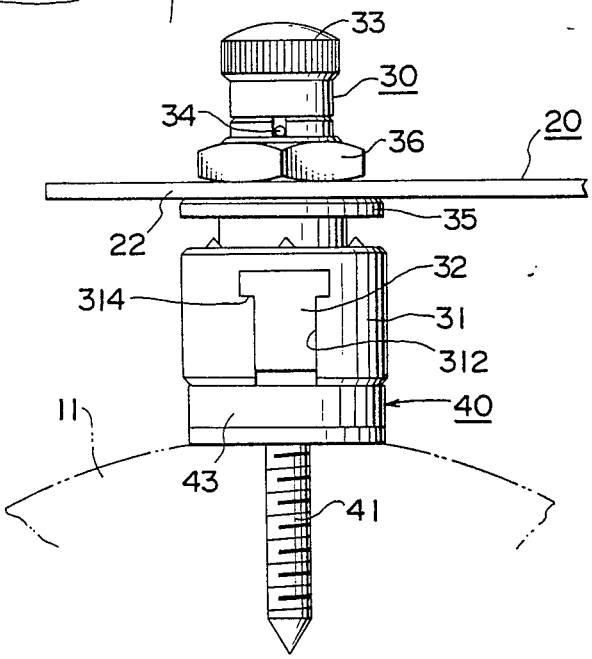
FIG. 2 is a side view of the connector in accordance with the present invention.

Said slideway 313 is provided with engaging steps 314 as shown in FIG. 2 and engaging pieces 32 and 32' are held against the upper internal surface of the engaging chamber 311 by these engaging steps 314.

Figure 5:
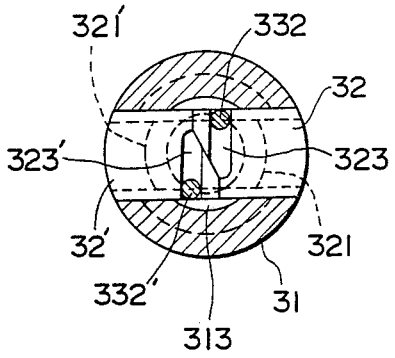
FIG. 5 is a crosssectional view along line A—A in FIG. 3.

Engaging edges 321 and 321' are formed on said engaging pieces 32 and 32' so that these engaging edges are positioned at the opening edge of said casing 31 and straight grooves 323 and 323' as shown in FIGS. 3 and 5 are provided on the rear surfaces of base blocks 322 and 322' inside said notches 312 and 312' so that the straight grooves 323 and 323' extend across base blocks 322 and 322' of said engaging pieces 32 and 32'.

Said casing 31 is provided with a manually operated knob 33 as shown in FIGS. 2 and 3 which has a shaft 331 at its center.

Said shaft 331 is adapted to be rotated by rotation of the knob 33 and the end of shaft 331 is exposed to the slideway 313 of said engaging chamber 311 and pins 332 and 332' which respectively engage with straight grooves 323 and 323' of said pair of engaging pieces 32 and 32' are provided at the end of this shaft.

Figure 6:
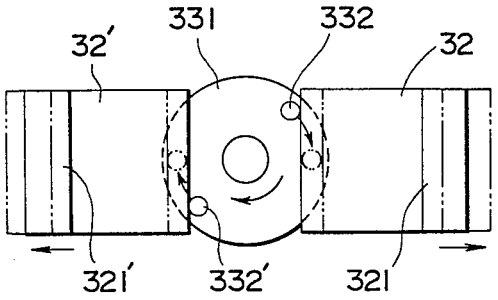
FIG. 6 is a diagrammatic illustration explaining the motion of the connector in accordance with the present invention.

Accordingly, said pair of engaging pieces 32 and 32' are symmetrically moved to approach each other or to move away from one another by rotating said shaft 331 to move said pins 332 and 332' along a circular locus as shown in FIG. 6.

Said shaft 331 is wound with a resetting spring 34 which always energize said shaft 331 and knob 33 so that said engaging pieces 32 and 32' are always moved toward each other and engaging edges 321 and 321' of said engaging pieces 32 and 32' are always forced to approach each other into the engaging chamber 311.

Said casing 31 is provided with a fastening means for the harness 20 and, in this embodiment, a washer 35 and a nut 36 are employed.

Said operation knob 33 is provided with a stopper pin 37 as shown in FIGS. 3 and 4 and this stopper pin 37 moves around the upper edge of said casing 31 when the knob 33 is rotated and serves to stop rotation of the knob 33 when the stopper pin 37 comes to the projection (not shown) provided on the upper edge of the casing 31.

Accordingly, the rotation of the operation knob 33 is set to a specified angle of rotation by the pin and thus the retracting distance of engaging pieces 32 and 32' is also limited.

On the other hand, said fixing member 40 is provided with a protrusion 42 which is fixed to the body 11 of said guitar 10 with a fixing means such as, for example, a wood screw 41 and this protrusion 42 is shaped so that its top part 421 is tapered toward the top end and can be pushed between engaging pieces 32 and 32' of said engaging member 30.

In other words, said protrusion 42 is adapted so that said pair of engaging pieces 32 and 32' can be retracted against the resetting spring 34 owing to the shape of its top part 521 when it is fitted under pressure into said engaging chamber 311.

Said protrusion 42 is provided with an engaging recession such as, for example, the groove 422 which surrounds the body of the protrusion 42 so that said engaging pieces 32 and 32' can be reset and engaged when said protrusion 42 is pushed into said engaging chamber 311, and the protrusion 42 is fixed unremovably to the engaging chamber 311 when this groove 422 is engaged with engaging pieces 32 and 32'.

Said fixing member 40 is provided with an elastic cover 43 at the mounting surface facing the string instrument if required. This elastic cover 43 is made of, for example, rubber or the like and capped onto the base of the protrusion 42 whereby the elastic cover 43 is positioned tightly between the edge of the casing 31 and the body of guitar 11 to fill the clearance formed between the casing 31 and the protrusion 42 as shown in FIG. 3 when the protrusion 42 is fitted into the engaging chamber 311, thus suppressing a vibratory sound caused by the clearance.

This elastic cover 43 is preferably adapted so that it closely contacts the chamber edge of the engaging member 30 as shown in FIG. 2 when the engaging member 30 engages with the fixing member 40 and, in addition, an elastic sheet 44 can be applied to this elastic cover 43. If the elastic cover is overlappingly assembled with the elastic sheet 44 as described above, the peripheral part of elastic sheet 44 can be bulged to increase the close contact force of the elastic cover 43 to the chamber edge when the fixing member 40 is fixed to the string instrument.

Said elastic cover 43 and said elastic sheet 44 similarly serve as the elastic cushioning means and therefore only one of these parts need be used.

The connector in accordance with the present invention can be changed or modified as far as it deviates from the spirit of the present invention and is not limited to the embodiment.

What is claimed is:

1. A connector for a string instrument and a harness, comprising:

an engaging member which has a casing provided with an engaging chamber which is open toward a string instrument side, at least two engaging pieces which are accommodated in said engaging chamber for movement forward and backward in the radial direction of said chamber, a resetting spring which biases said engaging pieces toward each other, an operation knob engagable with said engaging pieces for retracting said engaging pieces against the bias of said resetting spring when the knob is manually rotated in the circumferential direction, and a mounting means for positioning said casing at a position inside a harness and said operation knob on the outside of the harness;

a fixing member which has a protrusion having a top part which has a size for causing said engaging pieces to retract against said resetting spring when said protrusion is pushed into said engaging chamber of said engaging member and having an engaging recess positioned at a position nearer the string instrument than the top part and shaped for being engaged by said engaging pieces when said protrusion is pushed into said engaging chamber;

an elastic cover on the base of said protrusion and extending along the sides of said protrusion toward said engaging member, said elastic cover being adapted to be engaged between the edge of said casing of said engaging member and a string instrument when said protrusion is engaged inside said engaging chamber of said engaging member; and means for fixing said protrusion to a string instrument.

2. A connector for a string instrument and a harness, comprising:

an engaging member which has a casing provided with an engaging chamber which is open toward a string instrument side, at least two engaging pieces which are accommodated in said engaging chamber for movement forward and backward in the radial direction of said chamber, a resetting spring which biases said engaging pieces toward each other, an operation knob engagable with said engaging pieces for retracting said engaging pieces against the bias of said resetting spring when the knob is manually rotated in the circumferential direction, and a mounting means for positioning said casing at a position inside a harness and said operation knob on the outside of the harness;

a fixing member which has a protrusion having a top part which has a size for causing said engaging pieces to retract against said resetting spring when said protrusion is pushed into said engaging chamber of said engaging member and having an engaging recess positioned at a position nearer the string instrument than the top part and shaped for being engaged by said engaging pieces when said protrusion is pushed into said engaging chamber;

an elastic cover on the base of said protrusion and an elastic sheet on the face of said elastic cover which faces away from said engaging member, said elastic cover extending along the sides of said protrusion said engaging member, said elastic cover and said elastic sheet being adapted to be engaged between the edge of said casing of said engaging member and a string instrument when said protrusion is engaged inside said engaging chamber of said engaging member; and means for fixing said protrusion to a string instrument.

3. A connector for a string instrument and a harness, comprising:

an engaging member having a casing provided with an engaging chamber which is open at a string instrument side, at least two spaced opposed pieces slidably mounted in said casing for movement toward and away from each other in a radial direction within said chamber, a resetting spring means coupled with said engaging pieces and urging said engaging pieces toward each other, an operation knob rotatably mounted in said casing and having a shaft extending toward said engaging chamber, pins on one of said shaft and said engaging pieces and slots on the other of said shaft and said engaging pieces, said pins and slots being engaged for, when said knob is turned in one direction of rotation, urging said engaging pieces apart against the action of said resetting spring, and a harness mounting means for mounting said engaging member on said harness with said casing at a position inside the harness and said operation knob on the outside of the harness; and a fixing member having a protrusion having a top part having a size causing said engaging pieces to retract against the action of said resetting spring when said protrusion is pushed into said engaging chamber and having an engaging recess positioned at a position toward the string instrument end of said fixing member and having a shape for being engaged by said pieces when said protrusion is pushed into said engaging chamber, and a fixing means for fixing said protrusion to a string instrument.

* * * * *